US007172481B2

(12) United States Patent
Yeh

(10) Patent No.: US 7,172,481 B2
(45) Date of Patent: Feb. 6, 2007

(54) SPORTS BOARD

(76) Inventor: Tzong In Yeh, 4566 Crestwood St., Fremont, CA (US) 94538

( * ) Notice: Subject to any disclaimer, the term of this patent is extended or adjusted under 35 U.S.C. 154(b) by 0 days.

(21) Appl. No.: 11/329,287

(22) Filed: Jan. 11, 2006

(65) Prior Publication Data

US 2006/0110993 A1 May 25, 2006

Related U.S. Application Data

(63) Continuation of application No. 11/103,861, filed on Apr. 12, 2005, and a continuation-in-part of application No. 10/797,094, filed on Mar. 11, 2004, now Pat. No. 6,988,920.

(51) Int. Cl.
*B63B 1/00* (2006.01)

(52) U.S. Cl. ..... 441/65; 441/74
(58) Field of Classification Search ..... 441/65, 441/74
See application file for complete search history.

(56) References Cited

U.S. PATENT DOCUMENTS

| | | | | |
|---|---|---|---|---|
| 4,693,856 | A | 9/1987 | Rubens et al. | |
| 4,850,913 | A | 7/1989 | Szabad, Jr. | |
| 4,961,715 | A | 10/1990 | Shanelec | |
| 5,211,593 | A | 5/1993 | Schneider et al. | |
| 5,658,179 | A | 8/1997 | Glydon et al. | |
| 6,955,576 | B2 | 10/2005 | Yeh | |
| 7,029,349 | B2 * | 4/2006 | Lin | 441/65 |
| 2004/0176001 | A1 | 9/2004 | Yeh | |

* cited by examiner

*Primary Examiner*—Lars A. Olson
(74) *Attorney, Agent, or Firm*—Rosenberg, Klein & Lee

(57) ABSTRACT

A sports board comprises a foam core, a top layer bonded to a top surface of the foam core and a bottom layer bonded to a bottom surface of the foam core. The top layer comprises a top foam layer and a top film. The top foam layer is provided for bonding to the top surface of the foam core and has patterns imprinted thereon. Additionally, the top film is bonded to the top foam layer so as to cover the patterns, which are visible through the top film. Furthermore, the bottom layer comprises a bottom foam layer and a bottom plate. The bottom foam layer is provided for bonding to the bottom surface of the foam core, and the bottom plate is bonded to the bottom foam layer.

13 Claims, 6 Drawing Sheets

SPORTS BOARD

CROSS REFERENCE TO RELATED APPLICATION

This application is a continuation-in-part application of U.S. application Ser. No. 10/797,094, filed Mar. 11, 2004 now U.S. Pat. No. 6,988,920 and is also a continuation-in-part application of co-pending U.S. application Ser. No. 11/103,861, filed Apr. 12, 2005.

TECHNICAL FIELD

This invention relates generally to a sports board, which is provided for being as sports and recreational equipment, such as bodyboards, snow, grass or sand sports boards/sleds.

BACKGROUND OF THE INVENTION

A conventional sports board, such as a slider, a bodyboard and the like, mainly comprises a foam core, a top layer, a bottom layer and side rails. Another conventional sports board generally comprises a foam core, a top layer and a bottom layer. In general, the foam core of the conventional sports board is made of expanded polyethylene foam material. The top layer is a laminated layer which comprises a polyethylene film and/or a polyethylene foam sheet. Furthermore, the bottom layer is also a laminated layer similar to the top layer and the polyethylene film applied to the bottom layer sometime is thicker than the top layer so as to improve its wear-resistance when the sports board is sliding on the snow or other different grounds. Regarding to the structure of the sports board, the top layer and the bottom layer are easily to come off Additionally, colored graphics or patterns are imprinted on the top layer and the bottom layer of the sports board so as to improve the value and appearance of the sports board. However, the imprinted graphics are easily to fade and wear off due to the ultraviolet and frequently use outdoor. Therefore, the sports boards/sleds have enduring patterns and structures are in great demand.

SUMMARY OF INVENTION

The primary objective of the present invention is to provide a sports board with durable structures and patterns.

More particularly, the sports board comprises a foam core, a top layer bonded to a top surface of the foam core and a bottom layer bonded to a bottom surface of the foam core. The top layer comprises a top foam layer and a top film. The top foam layer is provided for bonding to the top surface of the foam core and has patterns imprinted thereon. Additionally, the top film is bonded to the top foam layer so as to cover the patterns, which are visible through the top film. Furthermore, the bottom layer comprises a bottom foam layer and a bottom plate. The bottom foam layer is provided for bonding to the bottom surface of the foam core, and the bottom plate is bonded to the bottom foam layer.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENTS

Figure 1:
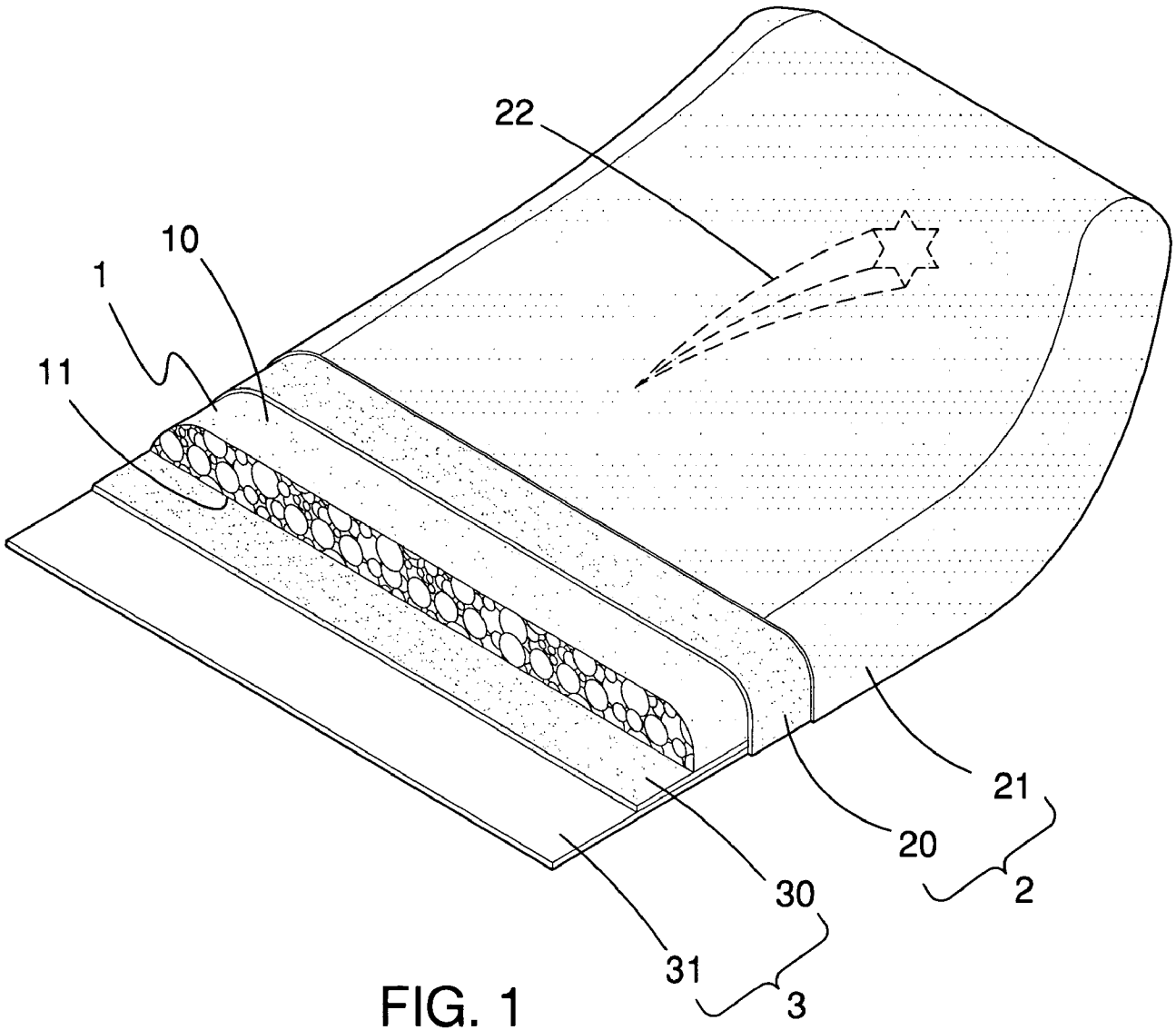
FIG. 1 is a perspective view of a first embodiment of the present invention.

FIGS. 1–5 show a sports board as a first embodiment of the present invention, and the sports board mainly comprises a foam core 1, a top layer 2 and a bottom layer 3 as shown in FIG. 1. The foam core 1 in the present invention is an expended foam board preferably made of a polyethylene, polystyrene or blended foam material, and has a density in a range of 0.8 to 8 PCF. Additionally, the foam core 1 has a top surface 10 and a bottom surface 11.

Figure 4:
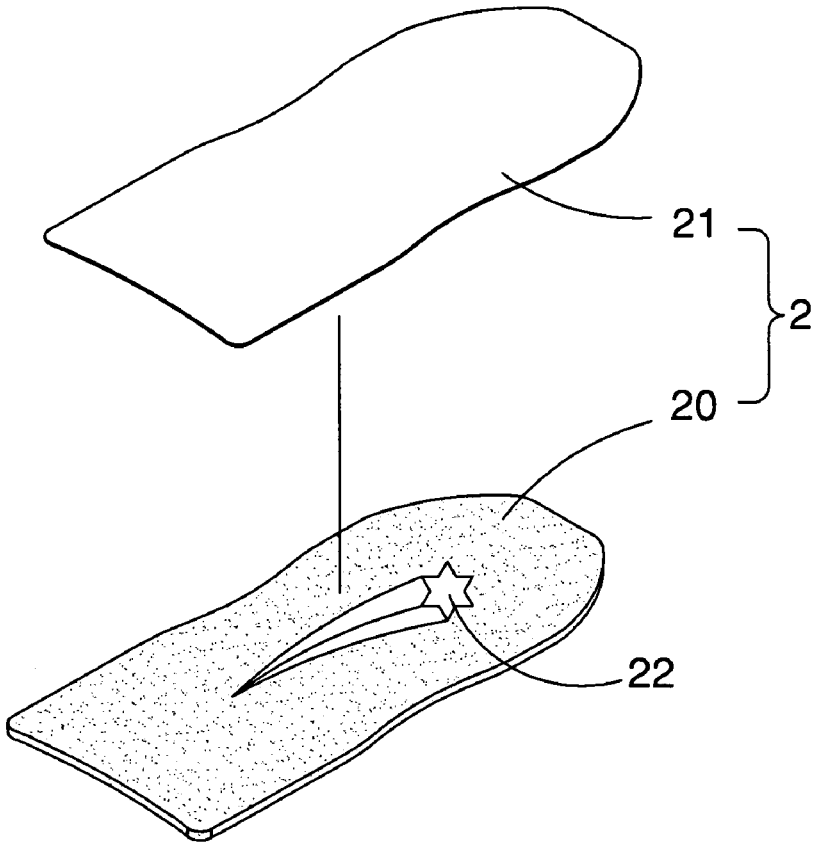
FIG. 4 is an exploded prospective view of the top layer of the first embodiment of the present invention.

The top layer 2 is bonded to the top surface 10 of the foam core 1, and comprises a top foam layer 20 and a top film 21. The top foam layer 20 is provided for bonding to the top surface 10 of the foam core 1, and the top foam layer 20 has patterns 22 imprinted thereon and has a density greater than the foam core 1. Furthermore, as shown in FIG. 4, the top film 21 is bonded to the top foam layer 20 so as to cover and to protect the patterns 22, which are visible through outside of the top film 21. The top film 21 is made of a plastic material, preferably a polyethylene film, and has a thickness in a range of 0.03 to 0.3 mm, and the top foam layer 20 is a polyethylene foam skin having the density in a range of 1.5 to 12 PCF.

Furthermore, the bottom layer 3 is bonded to the bottom surface 11 of the foam core 1 and comprises a bottom foam layer 30 and a bottom plate 31. The bottom foam layer 30 is provided for bonding to the bottom surface 11 of the foam core 1 and has a density greater than the foam core 1. The bottom plate 31 is bonded to the bottom foam layer 30. The bottom plate 31 is made of a plastic material, preferably a wearable polyethylene film, and has a thickness in a range of 0.3 to 2 mm. The bottom foam layer 30 is also a polyethylene foam skin having the density in a range of 1.5 to 12 PCF.

Figure 2:
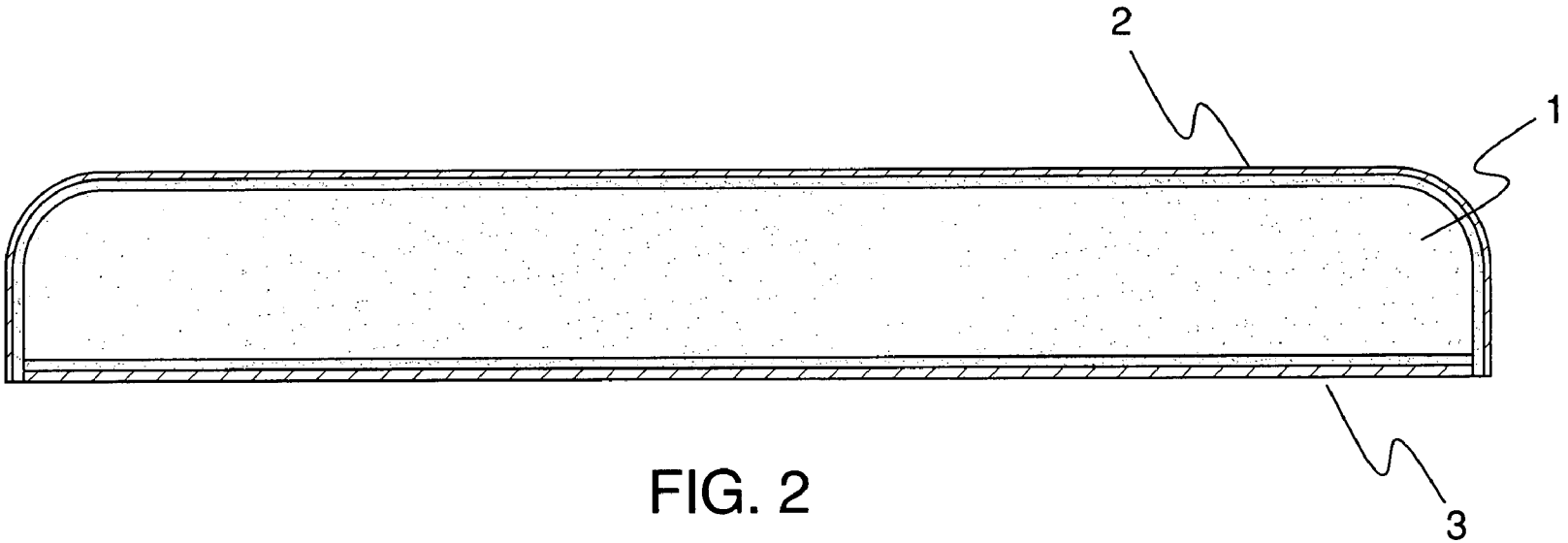
FIG. 2 is an enlarged cross sectional view of the first embodiment of the present invention, showing a top layer and a bottom layer being joined together to seal a foam core.
Figure 3:
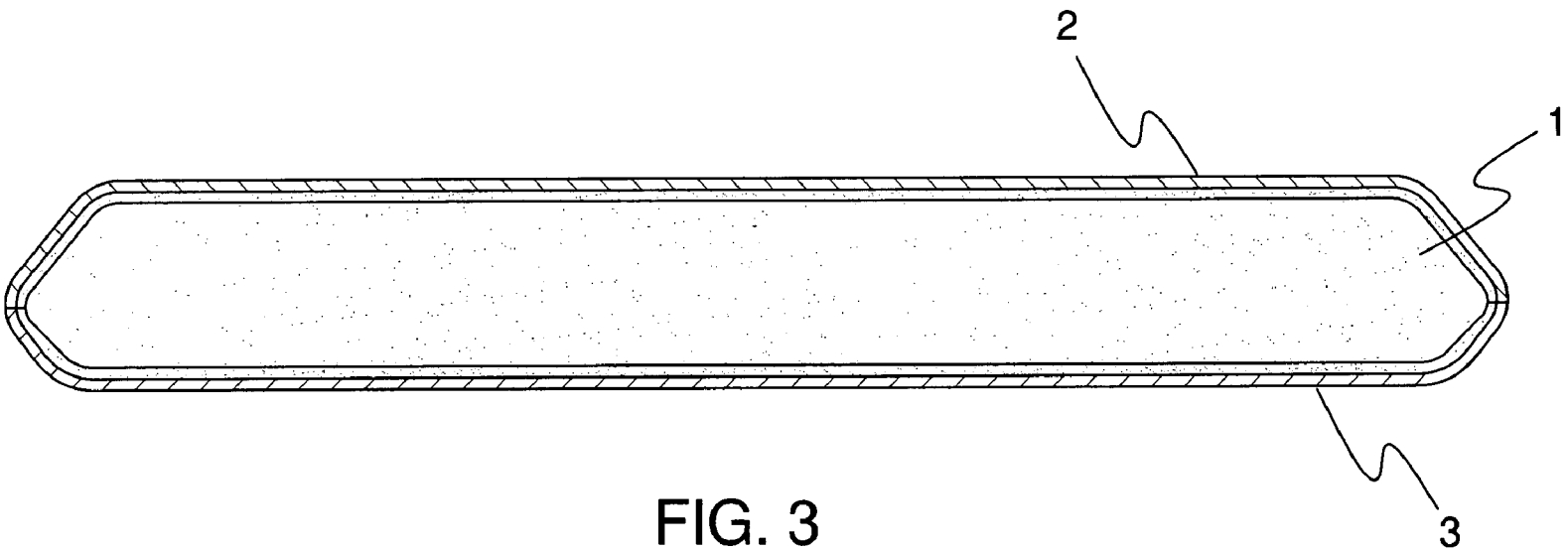
FIG. 3 is an enlarged cross sectional view of the first embodiment of the present invention, showing the top layer and the bottom layer being joined together to seal a different shape of a foam core.

FIGS. 2–3 respectively show that the top layer 2 and the bottom layer 3 are joined together to seal the foam core 1 completely. Because of the foam cores 1 shown in FIG. 2 and FIG. 3 are in different shapes, joins between the top layer 2 and the bottom layer 3 are different accordingly. Through such a combination, namely, the top layer 2 and the bottom layer 3 joined together to seal the foam core 1, the sports board does not require further side rails to seal the foam core 1.

Figure 5:
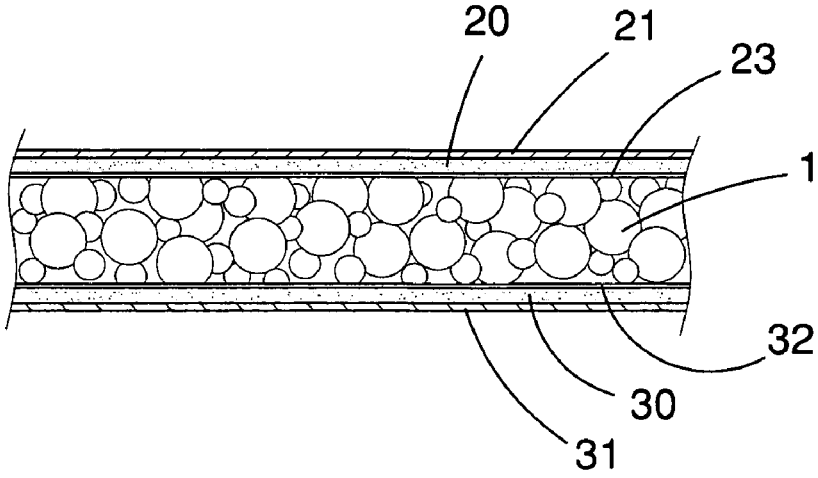
FIG. 5 is a partial cross sectional view of the first embodiment of the present invention, showing bonding films being applied.

In FIG. 5, the top layer 2 and the bottom layer 3 are bonded to the foam core 1 by bonding films 23, 32 respectively when the foam core 1 is made of the polystyrene foam material. The bonding films 23, 32 can be any adhesives or bonding agents. Preferably, the bonding films 23, 32 are copolymers which assist the top layer 2 and the bottom layer 3 to heat bond to the foam core 1 securely, because it is known that the polyethylene foam material is incompatible with the polystyrene foam material during heat bonding.

Figure 6:
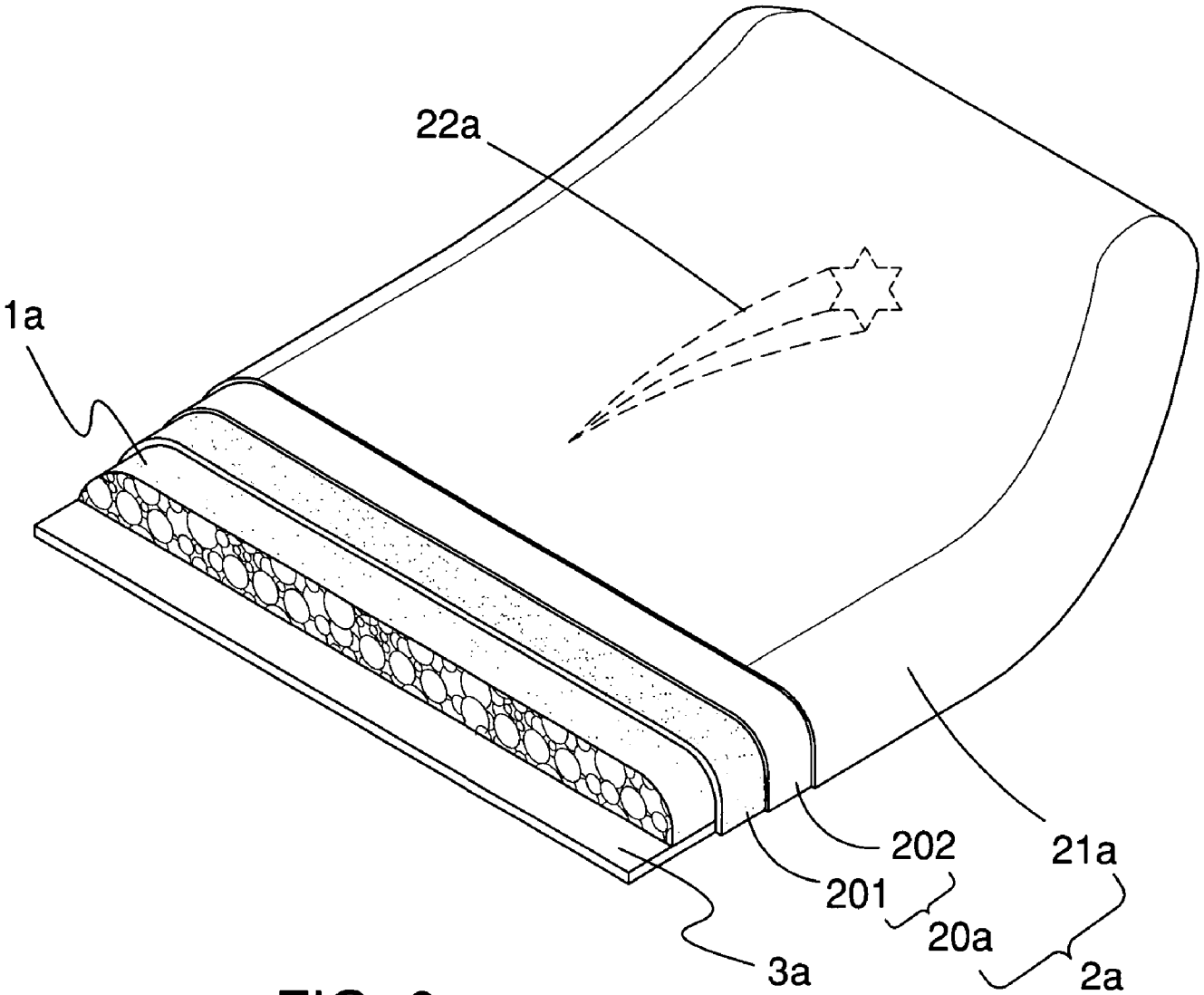
FIG. 6 is a perspective view of a second embodiment of the present invention.
Figure 7:
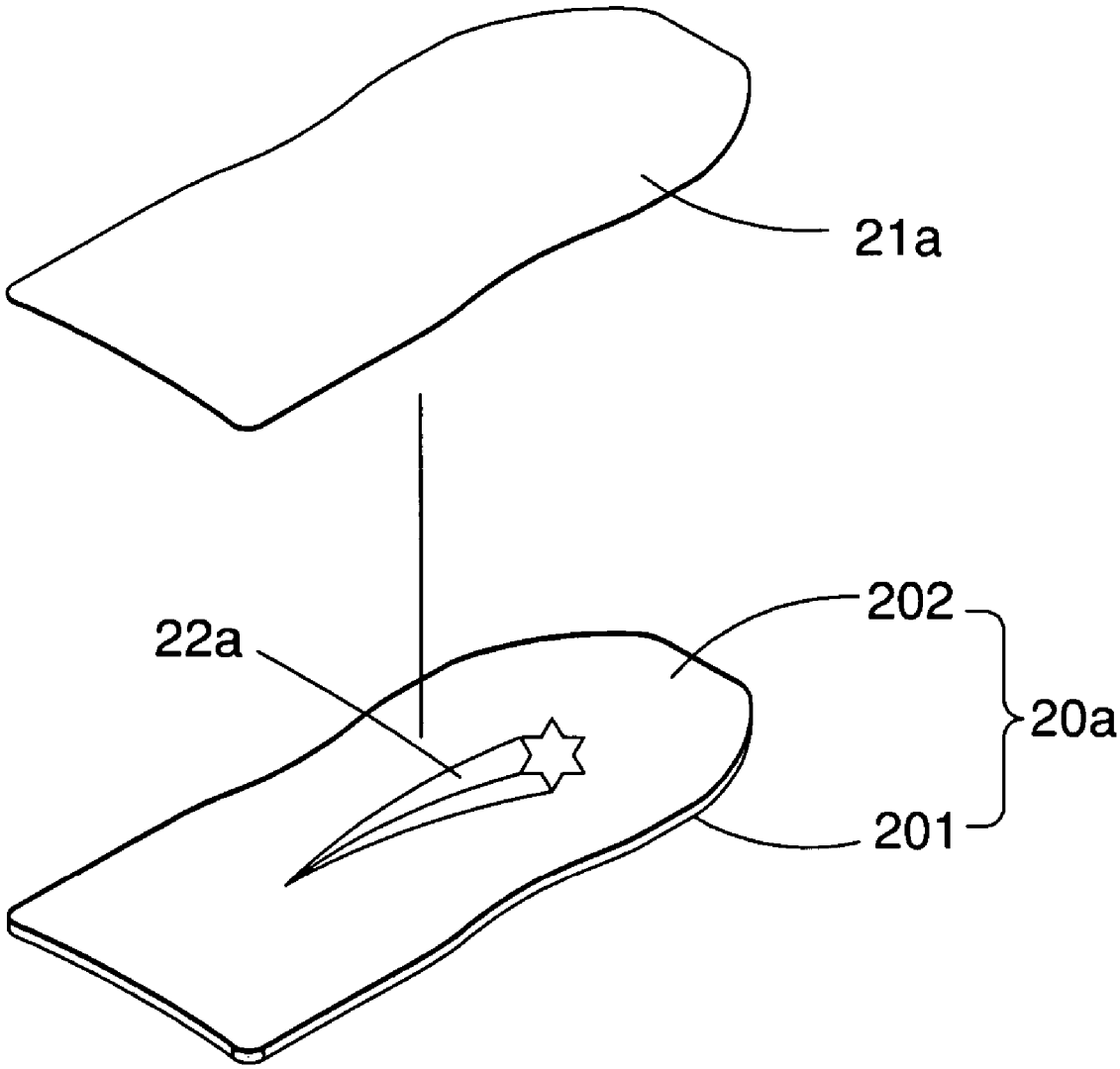
FIG. 7 is an exploded prospective view of the top layer of the second embodiment of the present invention.

A second embodiment of the present invention is shown in FIGS. 6–7, and discloses another sports board. Similar to the first embodiment, the second embodiment comprises a foam core 1*a*, a top layer 2*a* and a bottom layer 3*a*. The foam core 1*a* and the bottom layer 3*a* of the second embodiment are similar to the foam core 1 and the bottom layer 3 of the first embodiment. The top layer 2*a* of the second embodiment is similar to the top layer 2 of the first embodiment and comprises a top foam layer 20*a* and a top film 21*a*, which is similar to the top film 21 of the first embodiment.

Different to the first embodiment, the top foam layer 20*a* of the top layer 2*a* further comprises a polyethylene foam skin 201 and a plastic sheet 202. The polyethylene foam skin 201 is provided for bonding to the top surface of the foam core 1*a* and has a density in a range of 1.5 to 12 PCF. Additionally, the plastic sheet 202 is bonded to the polyethylene foam skin 201 and provided for imprinting patterns 22*a*. Accordingly, the plastic sheet 202 is covered by the top film 21*a* to protect the patterns 22*a*. By further applying the plastic sheet 202, which has a thickness in a range of in a range of 0.01 to 0.15 mm, the patterns 22*a* can be imprinted optimally.

Figure 8:
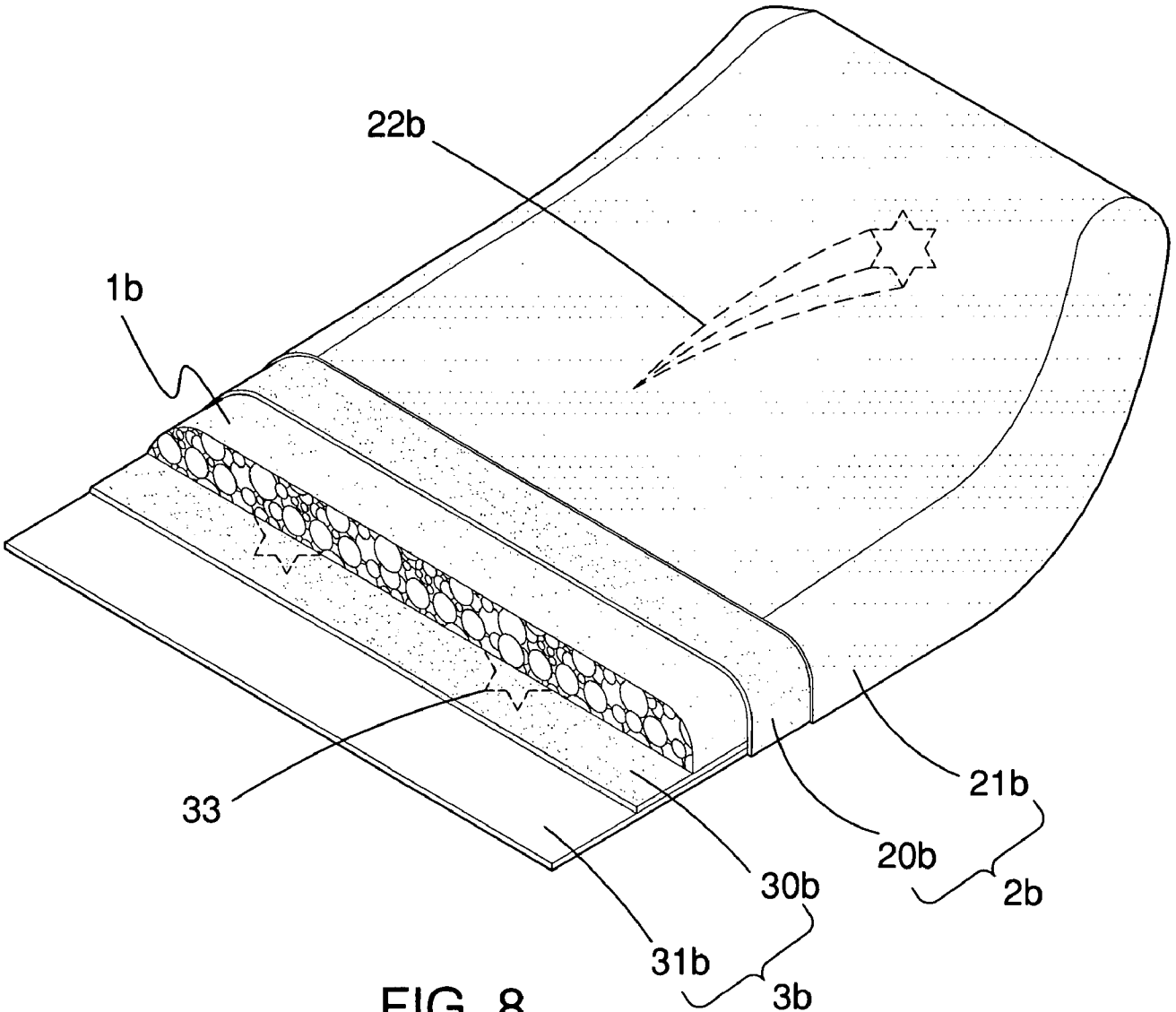
FIG. 8 is a perspective view of a third embodiment of the present invention.

FIG. 8 shows a third embodiment of the present invention. Similar to the first embodiment, the third embodiment comprises a foam core 1*b*, a top layer 2*b* and a bottom layer 3*b*. The top layer 2*b* comprises a top foam layer 20*b* and a top film 21*b*. The bottom layer 3*b* comprises a bottom foam layer 30*b* and a bottom plate 31*b*. Different to the first embodiment, not only the top foam layer 20*b* has the patterns 22*b* imprinted thereon, but also the bottom foam layer 30*b* has additional patterns 33 imprinted thereon. Accordingly, the additional patterns 33 are covered by and visible through the bottom plate 31*b* to improve and color the appearance of the sports board.

In the present invention, the patterns are preferably imprinted on a smooth side of the top foam layer and/or the bottom foam layer by imprinting devices to prevent the patterns from disfiguring and being uneven. Through the bonding films, such as the adhesives or the bonding agents, the whole structure of the sports board is accordingly strengthened.

Numerous characteristics and advantages of the invention have been set forth in the foregoing description, together with details of the structure and function of the invention, and the novel features thereof are pointed out in appended claims. The disclosure, however, is illustrated only, and changes may be made in detail, especially, in matters of shape, size and arrangement of parts, materials and the combination thereof within the principle of the invention, to the full extent indicated by the broad general meaning of the terms in which the appended claims are expressed.

I claim:

1. A sports board comprising:

a foam core, having a top surface and a bottom surface;

a top layer, bonded to the top surface of the foam core and comprising:

a top foam layer, provided for bonding to the top surface of the foam core, wherein the top foam layer has patterns imprinted thereon and has a density greater than the foam core; and a top film, bonded to the top foam layer so as to cover the patterns, which are visible through the top film; and a bottom layer, bonded to the bottom surface of the foam core and comprising:

a bottom foam layer, provided for bonding to the bottom surface of the foam core, and having a density greater than the foam core; and a bottom plate, bonded to the bottom foam layer.

2. The sports board of claim 1, wherein the top layer and the bottom layer are joined together so as to seal the foam core completely.

3. The sports board of claim 1, wherein the top film of the top layer and the bottom plate of the bottom layer are made of plastic materials, and the top film has a thickness in a range of 0.03 to 0.3 mm and the bottom plate has a thickness in a range of 0.3 to 2 mm.

4. The sports board of claim 1, wherein the foam core is a polyethylene foam core and has a density in a range of 0.8 to 8 PCF.

5. The sports board of claim 1, wherein the foam core is a polystyrene foam core and has a density in a range of 0.8 to 8 PCF.

6. The sports board of claim 4, wherein the top foam layer of the top layer comprises:

a polyethylene foam skin, provided for bonding to the top surface of the foam core, and having a density in a range of 1.5 to 12 PCF; and a plastic sheet, bonded to the polyethylene foam skin and provided for imprinting the patterns.

7. The sports board of claim 5, wherein the top foam layer of the top layer comprises:

a polyethylene foam skin, provided for bonding to the top surface of the foam core by a bonding film, and having a density in a range of 1.5 to 12 PCF; and a plastic sheet, bonded to the polyethylene foam skin and provided for imprinting the patterns.

8. The sports board of claim 4, wherein the top foam layer of the top layer and the bottom foam layer of the bottom layer are polyethylene foam skins, and have a density in a range of 1.5 to 12 PCF respectively.

9. The sports board of claim 5, wherein the top foam layer of the top layer and the bottom foam layer of the bottom layer are polyethylene foam skins and have a density in a range of 1.5 to 12 PCF respectively, and wherein the top foam layer and the bottom foam layer are bonded to the foam core by bonding films respectively.

10. The sports board of claim 8, wherein the top film of the top layer and the bottom plate of the bottom layer are made of plastic materials, and the top film has a thickness in a range of 0.03 to 0.3 mm and the bottom plate has a thickness in a range of 0.3 to 2 mm.

11. The sports board of claim 9, wherein the top film of the top layer and the bottom plate of the bottom layer are made of plastic materials, and the top film has a thickness in a range of 0.03 to 0.3 mm and the bottom plate has a thickness in a range of 0.3 to 2 mm.

12. The sports board of claim 10, wherein the bottom foam layer of the bottom layer has additional patterns imprinted thereon and the additional patterns are covered by the bottom plate of the bottom layer, and wherein the additional patterns are visible through the bottom plate.

13. The sports board of claim 11, wherein the bottom foam layer of the bottom layer has additional patterns imprinted thereon and the additional patterns are covered by the bottom plate of the bottom layer, and wherein the additional patterns are visible through the bottom plate.

* * * * *